US011236565B2

(12) United States Patent
Petrie et al.

(10) Patent No.: US 11,236,565 B2
(45) Date of Patent: Feb. 1, 2022

(54) SETTING BRIDGE PLUG ON WIRELINE THROUGH CORE BIT

(71) Applicant: Halliburton Energy Services, Inc., Houston, TX (US)

(72) Inventors: Robert Alexander Petrie, Gunnison, CO (US); Michael John Houston, Bell Fourche, SD (US); Mark Holly, The Colony, TX (US); Jack Gammill Clemens, Fairview, TX (US); Grant Spark, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 3 days.

(21) Appl. No.: 16/753,987

(22) PCT Filed: May 7, 2018

(86) PCT No.: PCT/US2018/031450

§ 371 (c)(1),
(2) Date: Apr. 6, 2020

(87) PCT Pub. No.: WO2019/117988

PCT Pub. Date: Jun. 20, 2019

(65) Prior Publication Data

US 2020/0392804 A1 Dec. 17, 2020

Related U.S. Application Data

(60) Provisional application No. 62/599,150, filed on Dec. 15, 2017.

(51) Int. Cl.
*E21B 23/06* (2006.01)
*E21B 33/134* (2006.01)

(52) U.S. Cl.
CPC ..... *E21B 23/06* (2013.01); *E21B 33/134* (2013.01)

(58) Field of Classification Search
CPC ..... E21B 23/06; E21B 33/134; E21B 23/08; E21B 47/00; E21B 33/12; E21B 23/00; E21B 33/129
See application file for complete search history.

(56) References Cited

U.S. PATENT DOCUMENTS 2,620,036 A * 12/1952 Morgan ..... E21B 33/1294 166/130
4,784,226 A 11/1988 Wyatt
(Continued)

FOREIGN PATENT DOCUMENTS

WO WO-2010115188 A2 * 10/2010 ..... E21B 33/134

OTHER PUBLICATIONS

International Application No. PCT/US2018/031450, "International Search Report and Written Opinion", dated Sep. 14, 2018, 13 pages.

*Primary Examiner* — Daniel P Stephenson
(74) *Attorney, Agent, or Firm* — Kilpatrick Townsend & Stockton LLP

(57) ABSTRACT

A setting tool and bridge plug that are run-in-hole on wireline through a core bit while drill rods are in place can be used to plug a borehole. A setting tool can be sized to have a same or smaller diameter as a drill rod. A bridge plug can have a run-in configuration of a diameter that is smaller than an inner diameter of a core bit. The bridge plug can have a set configuration that can respond to the setting tool pulling uphole. The bridge plug can be positioned below a drill bit of the drill rod in the set configuration, and the diameter of the bridge plug in the set configuration can be greater than the diameter of the drill rod.

19 Claims, 7 Drawing Sheets

(56) References Cited

U.S. PATENT DOCUMENTS

| | | | | |
|---|---|---|---|---|
| 5,351,765 | A * | 10/1994 | Ormsby | E21B 25/02 175/246 |
| 5,819,846 | A | 10/1998 | Bolt, Jr. | |
| 8,016,053 | B2 * | 9/2011 | Menezes | E21B 47/00 175/262 |
| 8,555,986 | B2 * | 10/2013 | Clemens | E21B 23/01 166/382 |
| 9,702,196 | B2 * | 7/2017 | Adams | E21B 23/004 |
| 10,242,312 | B2 * | 3/2019 | Storm, Jr. | E21B 49/005 |
| 2008/0173481 | A1 | 7/2008 | Menezes et al. | |
| 2010/0096187 | A1 * | 4/2010 | Storm, Jr. | E21B 23/14 175/50 |
| 2011/0073328 | A1 | 3/2011 | Clemens et al. | |
| 2013/0056200 | A1 | 3/2013 | Martinez et al. | |
| 2015/0345248 | A1 * | 12/2015 | Carragher | E21B 33/1204 166/57 |
| 2017/0342798 | A1 * | 11/2017 | Wutherich | E21B 33/1208 |
| 2020/0392804 | A1 * | 12/2020 | Petrie | E21B 33/134 |

* cited by examiner

SETTING BRIDGE PLUG ON WIRELINE THROUGH CORE BIT

TECHNICAL FIELD

The present disclosure relates to devices usable in a borehole environment for drilling. More specifically, this disclosure relates to setting bridge plugs using wireline in open hole through a core bit while drill rods are in place.

BACKGROUND

Drilling a borehole can require a variety of drilling tools that are run-in-hole through drill rods to perform various drilling operations. Certain phases of borehole drilling can require plugging the borehole to initiate directional drilling or abandonment. A bridge plug is downhole tool that can be positioned and set to isolate the lower part of a borehole. Bridge plugs can be permanent, enabling the lower borehole to be permanently sealed from production or temporarily isolated from a treatment conducted on an upper zone. To enable installation of a bridge plug, multiple drill rod trips (e.g., removal from and reinsertion to the borehole) can be required as a result of bridge plug dimensions exceeding the inner diameter of the drill rods.

DETAILED DESCRIPTION

Figure 1:
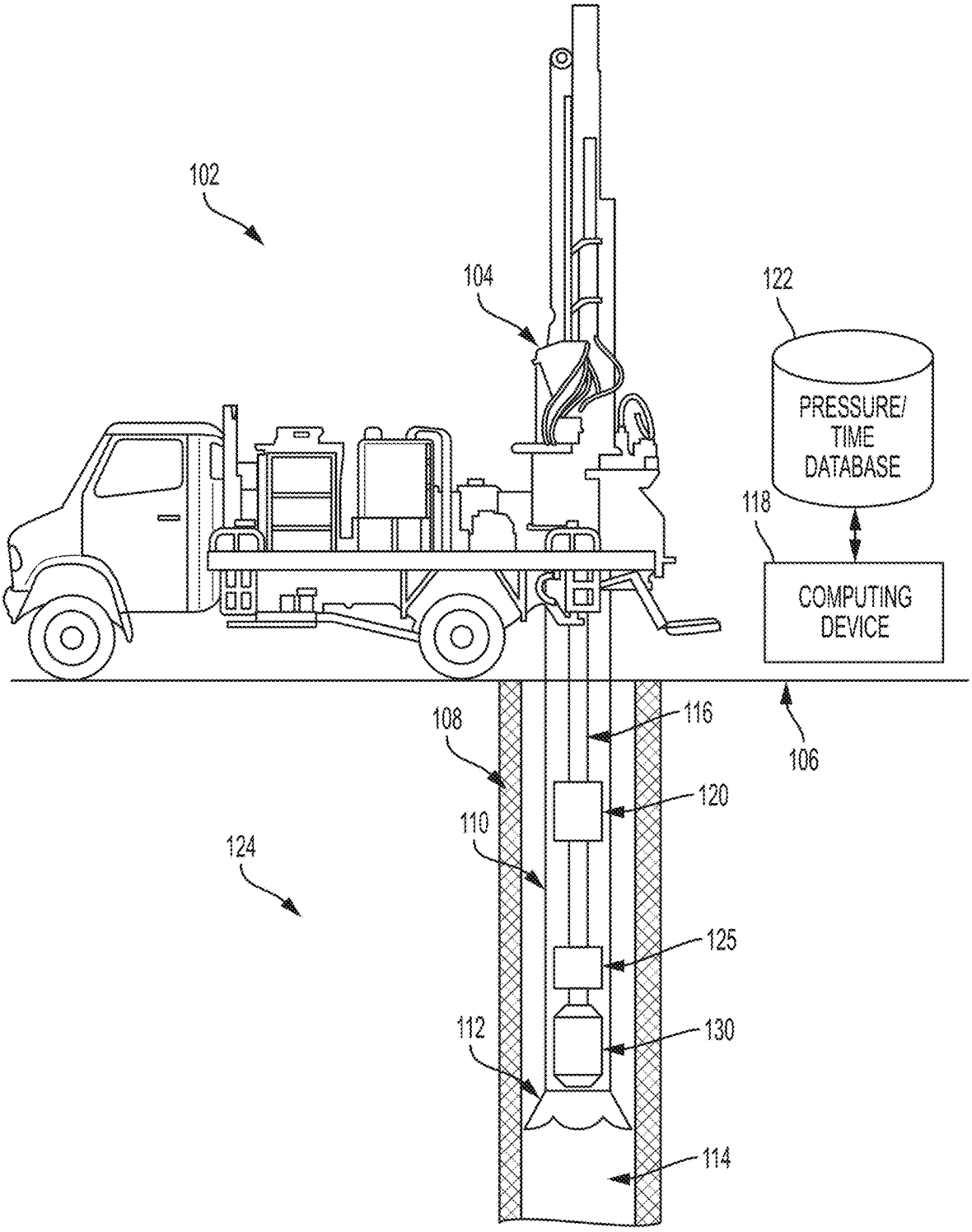
FIG. 1 is a cross-sectional view of an example of a borehole drilling environment according to some aspects of the present disclosure.

Certain aspects and features relate to setting bridge plugs in open hole, while the drill rods are in place. A setting tool can be used to engage a step up gearbox to gradually and smoothly apply torque to a bridge plug (BP). A high-expansion BP (HEBP) with a run-in-hole (RIH) diameter with half of the full expansion diameter, so that the HEBP can fit through core bit and then expand. The setting tool can record pressure versus time data. Once the setting tool is retrieved, the data can be downloaded and compared with known pressure versus time data for shear pins used in HEBP. If the two curves overlap, there is high confidence that HEBP was set correctly. This methodology can increase probability of successful BP set and reduces potential damage to the formation. Certain aspects of the embodiments can reduce the number trips needed to set a bridge plug to a single trip.

In mining and mineral exploration, BPs can be set downhole using the drill rod and mechanical energy (e.g., torque) from the surface. To set the bridge plug in an open hole, the core drill bit, core barrel, and drill rod are tripped from the hole (i.e. removed from the borehole). Following the bit trip out, the bridge plug is tripped in (i.e. run downhole) to depth on the end of drill rod. Following the bridge plug being set, the drill rod is tripped from hole. Using the currently available technology, a total of three rod trips are used to set a bridge plug.

Multiple trips into and out of the borehole can increase cost, loss of borehole integrity and inefficiency of a drilling operation. Furthermore, using rotational energy of drill rods to torque up and set a BP can result in over torqueing the BP and damaging the formation, resulting in BP failure. And, when there is a failure in setting the BP, it may not be possible to determine the cause currently. Current BPs used in core drilling applications do not have an expansion ratio high enough to enable both the working inside of drill rods, run through core bit, and expand to open hole diameter. For example, the standard core hole is about four inches in diameter and the inner diameter of a core bit is about 2.5 inches. Current core drilling BPs that have a RIH diameter of less than 2.5 inches cannot expand to four inches.

Non-productive rig time can be a significant cost driver in the mineral exploration drilling business. Tripping rods is one form of non-productive time. Tripping rods is a high exposure task for injury to an employee so risk and exposure for a potential injury are minimized. Additional wear and tear on equipment is reduced by limiting the additional rod trips. A Placement through Bit (PTB) technique according to some examples can reduce the standard three rod-trip time to set an open-hole bridge plug to one trip.

In one example, a PTB plug setting technique is used to set an HEBP. PTB can be achieved directly through the core drill bit without having to make an initial rod trip. A rig wireline can be employed to lower a setting tool, a setting kit, and an HEBP. The setting kit and the HEBP can be lowered through the core bit into the open hole. The setting tool can remain above the crown of the core bit.

A smaller run-in-hole diameter, combined with a high expansion ratio, can allow the HEBP to be set through the crown of the core bit such that rods are not required to be tripped out prior to setting the BP. The setting tool and HEBP can be run in hole faster on wireline (e.g., approximately 400 ft/min) than traditional method rod tripping. Exploration drilling cost per foot can be reduced and core production rates can be increased by reducing rod trips and non-productive time.

The setting tool can be a tool or device that is used in the placement or setting of downhole equipment such as permanent packers, plugs, or slickline locks. The setting tool can be retrieved after the operation or setting process. In some cases, the setting tool can be used to retrieve the equipment or tool that has been set in the borehole. In some examples, the setting tool can be a device or mechanism useable to apply mechanical force to the setting kit to set the HEBP. For example, the setting tool can be a downhole power unit (DPU).

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 depicts a cross-sectional view of a borehole drilling environment 102 that includes a borehole drill assembly 104 according to one example. The borehole drilling environment 102 can include a borehole 108 extending through various earth strata. The borehole 108 can extend through a hydrocarbon-bearing subterranean formation 124. A borehole 108 may be created by drilling into the subterranean formation 124 using the borehole drill assembly 104. The borehole drill assembly 104 can be driven and can be positioned above at the surface 106 or otherwise arranged within the borehole 108. The borehole drill assembly 104 may be used in other drilling environments other than mining such as wellbore oil drilling, and may include any tools necessary to implement conventional methods of drilling.

The borehole drill assembly 104 can include a winch used to lower and raise the components within the borehole 108. The borehole drill assembly 104 can include various drilling components to set a bridge plug in an open hole while drill rod 110 remains in place. The borehole drill assembly 104 can include a wireline 116, DPU 120, setting kit 125, HEBP 130, drill rod 110, and drill bit 112. In some examples, the wireline 116 can be a sand line, which is capable of significantly higher tensile forces than a slickline or electric wireline. In other examples, the wireline 116 can be a solid steel line or a wire-braided line.

The borehole drill assembly 104 can be a dual tube system, such that the wireline 116, DPU 120, setting kit 125, and HEBP 130 are inserted into and travel through the drill rod 110. The drill bit 112 can be affixed to the drill rod 110 to perform conventional drilling and mining operations independent of the wireline 116, DPU 120, setting kit 125, and HEBP 130. The DPU 120, setting kit 125, and HEBP 130 can be temporarily affixed to or within the wireline 116 so that the DPU 120, setting kit 125, and HEBP 130 may be lowered or raised along with the wireline 116 via the winch of the borehole drill assembly 104. The drill bit 112 may be moved axially within a drilled borehole 108. The drill bit 112 can have an opening portion of an inner diameter sufficiently large enough for the HEBP 130 to pass through the drill bit 112 to be positioned below the drill bit 112.

The borehole 108 can include fluid 114. The fluid 114 can flow in an annulus positioned between the borehole drill assembly 104 and a wall of the borehole 108. The HEBP 130 can be used to seal off the fluid 114 or any other undesirable substance or material from the portions of the borehole 108 positioned above the HEBP 130 in a set configuration.

In some examples, the DPU 120 can be configurable to record pressure versus time data during configuration of the HEBP 130 into the set configuration (i.e. expanded against the walls of the borehole 108). The pressure data can be recorded by one or more sensors located within the borehole 108 that are communicatively coupled to the DPU 120, or the DPU 120 can include any number of sensors or tool necessary to measure pressure within the borehole 108. Pressure versus time data recorded by the DPU 120 can be compared against known pressure versus time data points to determine a probability that the HEBP 130 was configured into the set configuration without error.

In some examples, the borehole drilling environment 102 can include a computing device 118 and pressure/time database 122 at the surface 106. The computing device 118 can include a controller, a memory device, a communications port, or any other electronic components necessary for transceiving data with the DPU 120 and the pressure/time database 122 for purposes of comparing recorded pressure versus time data against known pressure versus time data. Upon removal from the borehole 108, the DPU 120 can be communicatively coupled to the computing device 118 at the surface 106 to transceive recorded pressure versus time data corresponding to the setting of the HEBP 130. The computing device 118 can then receive known pressure versus time data from the pressure/time database 122. The pressure/time database 122 can include known pressure versus time data for installations of HEBPs in a variety of subterranean formations, such that different types of formations may produce different pressure values exerted upon the HEBP 130. The known pressure versus time values can be ideal data points which are known to have been recorded during successful HEBP installations. The computing device 118, after receiving data from both the DPU 120 and the pressure/time database 122, can compare the recorded pressure versus time data and the known pressure versus time data to determine if the installation of the HEBP 130 was successful. A closer match between the two data sets can represent a successful installation of the HEBP 130, while a divergence between the two data sets can represent a failed or erroneous installation of the HEBP 130. In some examples, the known pressure versus time data points can be referred to as shear points when shear pins are used, where a shear point measurement can be the force required to shear the HEBP 130 from the setting kit 125.

The ability of the DPU 120 to provide a mechanism for verifying whether installation of the HEBP was successful can increase overall operating efficiency and safety. Providing additional means to validate stages of drilling operations can improve certainty and therefore eliminate the need to duplicate borehole plugging efforts, saving operational cost and time.

Figure 2:
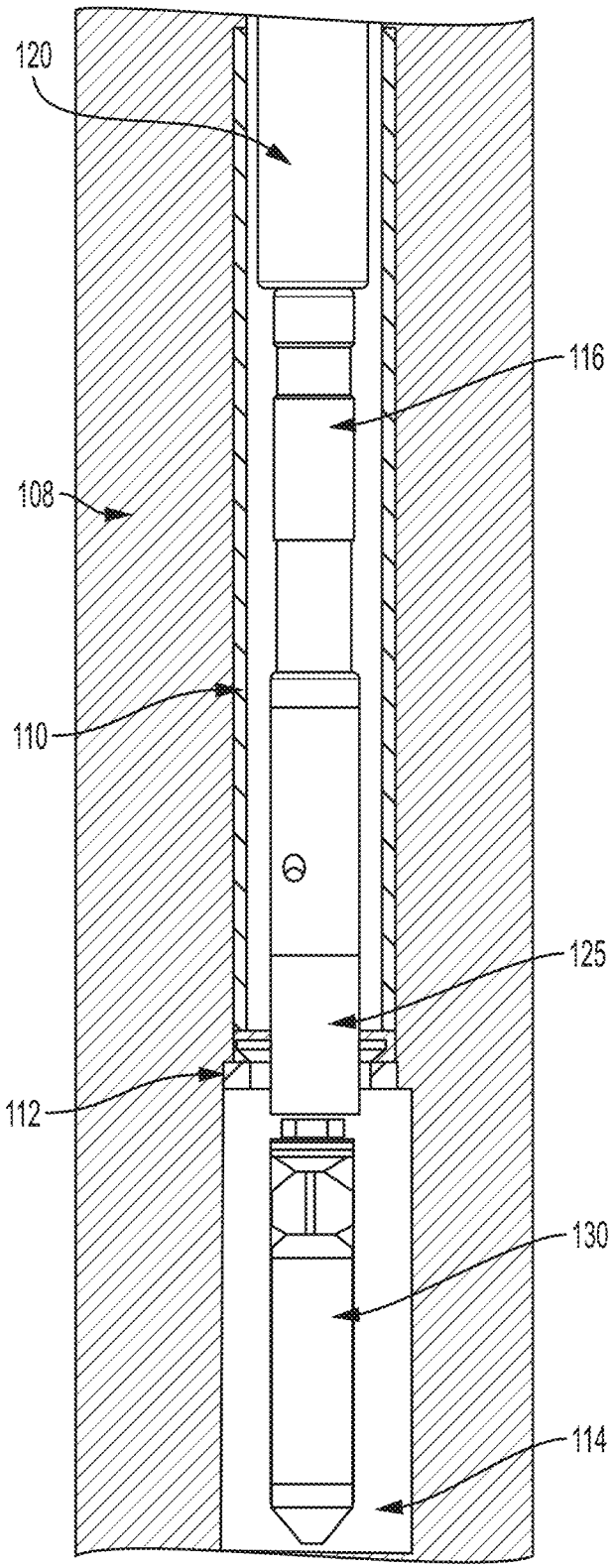
FIG. 2 is a cross-sectional view of an example of a bridge plug setting system in a run-in configuration according to some aspects of the present disclosure.

FIG. 2 depicts a cross-sectional view of an example of a bridge plug setting system in a run-in configuration according to one example. The run-in (i.e. run-in-hole) configuration can involve lowering the DPU 120, setting kit 125, and HEBP 130 via a wireline 116. Embodiments provide a means for setting the HEBP 130, via the DPU 120 and setting kit 125, below the drill bit 112 to form a seal within the borehole 108.

The DPU 120, setting kit 125, HEBP 130 and wireline 116 can be sized such that their respective diameters are able to move freely within the drill rod 110. The setting kit 125 and the HEBP 130 can have a smaller diameter than the inner diameter of the drill bit 112, such that they can be inserted through the drill bit 112. The DPU 120 can have a diameter (e.g., 2.5 inches) that can fit inside standard drill rods. The HEBP 130 can have an expansion ratio of two to one and can be initially sized (e.g. 2.2 inches in diameter) to fit through a crown (e.g., inner diameter) of a drill bit 112. The HEBP 130 can expand upon being set to a diameter (e.g., 4.5 inches) that is greater than an open hole diameter (e.g., 4 inches).

The HEBP 130 can be lowered into the open hole past the drill bit 112 via a winch connected to the wireline 116 so that it is in a position clear of the drill bit 112 and other encumbrances prior to expansion. The setting kit 125 may not need to pass through the drill bit 112, so long as the HEBP 130 is in a position to radially expand, forming a seal against the walls of the borehole 108. Once the HEBP 130 is in position to expand, the various components shown can transition from a run-in configuration to a set configuration.

Figure 3:
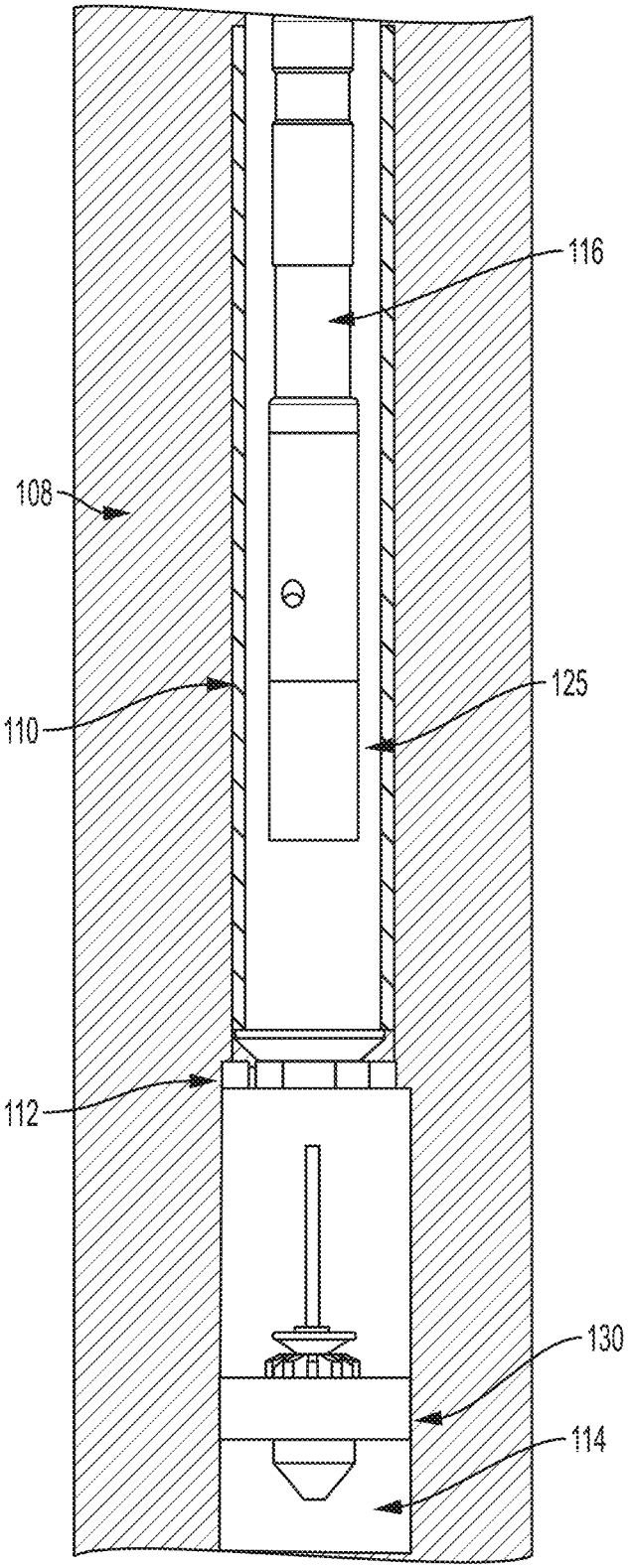
FIG. 3 is a cross-sectional view of an example of a bridge plug setting system in a set configuration according to some aspects of the present disclosure.

FIG. 3 depicts a cross-sectional view of an example of a bridge plug setting system in a set configuration according to one example. As shown in FIG. 3, the HEBP 130 is in a set configuration, and the remaining components (e.g., DPU 120, setting kit 125), which are detached from the HEBP 130, are in a trip-out configuration (i.e. they are being raised out of the borehole 108 through the drill rod 110 via the wireline 116 attached to a winch).

The DPU 120 can initiate a set configuration for the HEBP 130 by applying mechanical energy directly to the HEBP 130. The DPU 120 can include an electronic/timer housing, power supply, and a step up gearbox, to supply mechanical energy to the HEBP 130 through the setting kit 125. Prior to lowering the DPU 120 and HEBP 130 into the borehole 108, the timer can be set to ensure there is sufficient time between lowering the components until set point and gearbox activation. Once the timer reaches zero, power to the gearbox can be supplied to initiate rotating torque on the setting kit. In some examples, the DPU can supply up to 30,000 lb. of force at the setting kit to set and shear (i.e. disconnect) the HEBP 130. The mechanical energy (e.g., torque) can be supplied evenly over time to the HEBP 130 to ensure equal distribution of the HEBP 130 against the walls of the borehole 108, and to prevent over-torqueing that may damage the HEBP 130 and any other components.

After a sufficient amount of torque is applied to the HEBP 130 by the DPU 120 through the setting kit 125, the setting kit 125 can disconnect the HEBP 130 so that it remains stationary in a set configuration. The HEBP 130 in the set configuration can have an expanded diameter that is greater than the diameter of the drill rod 110. Note that the torque required to shear off the HEBP 130 from the setting kit 125 can be greater than or equal to the torque required to fully expand the HEBP 130 within the borehole 108 (i.e. the HEBP 130 will form a seal prior to or at the same time the setting kit 125 shears off the HEBP 130).

After the HEBP 130 is in the set configuration, the DPU 120 and setting kit 125 can be tripped out of the drill rod 110. In some examples, the setting kit 125 can allow for a controlled exit for components extending through and beyond the inner diameter of the drill bit 112. The setting kit 125 can be appropriately shaped to be pulled back through the inner diameter of the drill bit 112 with limited or no resistance so as not to become stuck or caught on the drill bit 112.

In some examples, the drill rod 110 can rotate during the run-in and set configurations, as well as during tripping out the DPU 120 and setting kit 125. The drill rod 110 can continuously rotate around the DPU 120, setting kit 125, and any other components attached to the wireline 116, so that the drill rod 110 does not become lodged against or impeded by various viscous materials of the subterranean formation 124 in the borehole 108. Rotating the drill rod 110 continuously during run-in, set, and trip-out configurations can reduce issues encountered when the drill rod 110 is tripped-out from the borehole 108.

In some examples, the DPU 120 can be an electromechanical actuating device. In some examples, the DPU 120 can be battery-powered, such that the mechanical energy, which is transferred to the setting kit 125 to torque the HEBP 130 to the set configuration, is sourced from batteries connected to or housed within the DPU 120. The functions of the DPU 120 according to other examples (e.g., recording pressure versus time data) can also be powered by such batteries.

Passing the HEBP 130 through the inner diameter of the drill bit 112 and expanding the HEBP 130 beneath the drill bit 112 to form a seal against the walls of the borehole 108 can reduce the number of total rod trips from at least three trips (e.g., removing the rod, inserting a new rod with a bridge plug on the end, removing the new rod after setting the bridge plug) to one trip (e.g., removing the rod after the borehole 108 is sealed). The reduction in total number of trips can allow for increased operating efficiency, reduction in equipment deterioration, and increase in borehole operator safety.

Figure 4:
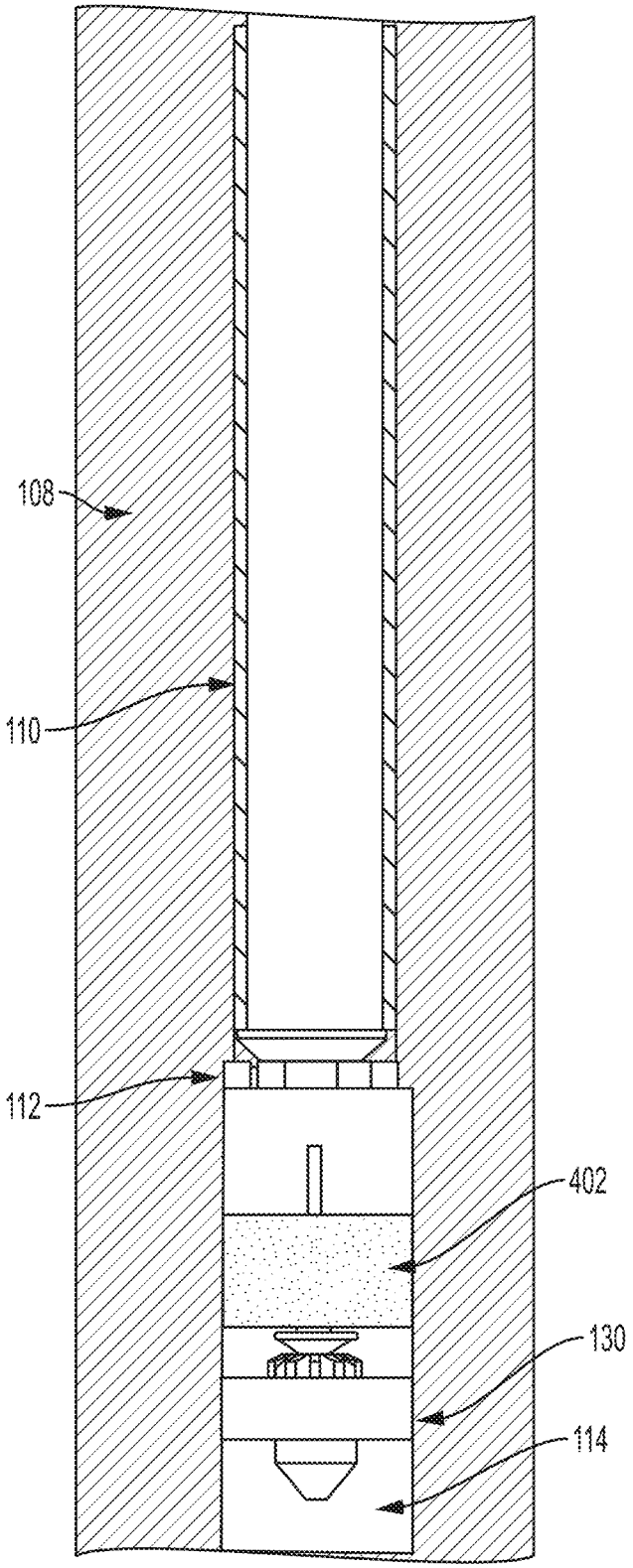
FIG. 4 is a cross-sectional view of an example of a bridge plug setting system with a sealant being applied according to some aspects of the present disclosure.

FIG. 4 depicts a cross-sectional view of a bridge plug setting system with a sealant being applied according to one example. After the HEBP 130 is successfully in set configuration and the DPU 120 and setting kit 125 have been tripped-out, a sealant 402 may be deposited on top of the HEBP 130 to reinforce the seal. The sealant can include any sealant used in conventional borehole sealing methods (e.g., cement).

Plugging boreholes can be required for a variety of reasons when implementing conventional drilling methods, including (i) solving a lost-circulation problem during by spotting a cement plug across the thief zone and then drilling back through the plug, (ii) sealing off selected intervals of a borehole or abandoning an entire borehole altogether because it is dry or depleted, (iii) sidetracking or to initiate directional drilling to help guide the drill bit in the desired direction, (iv) providing an anchor for an open hole test, particularly when the zone to be tested is significantly off bottom, and other remedial work. To address these and other problems, plugs are designated at specific points located within a borehole, typically not at the bottom of the borehole. As such, it can be challenging to accurately deposit a relatively small amount of cement slurry above a larger volume of borehole fluid.

It is essential to drilling operations that a satisfactory cement plug is placed the first time. Properly placing the designed cement plug helps reduce nonproductive rig time, minimize wasted material, and mitigate the need for additional cementing services. Having the HEBP 130 act as a bottommost point in which to apply the sealant 402 can provide an increased certainty that a sealant is being applied at a specified depth and depth threshold above the fluid 114 within the borehole 108. In addition to providing two seal mechanisms as opposed to the conventional single seal.

Figure 5:
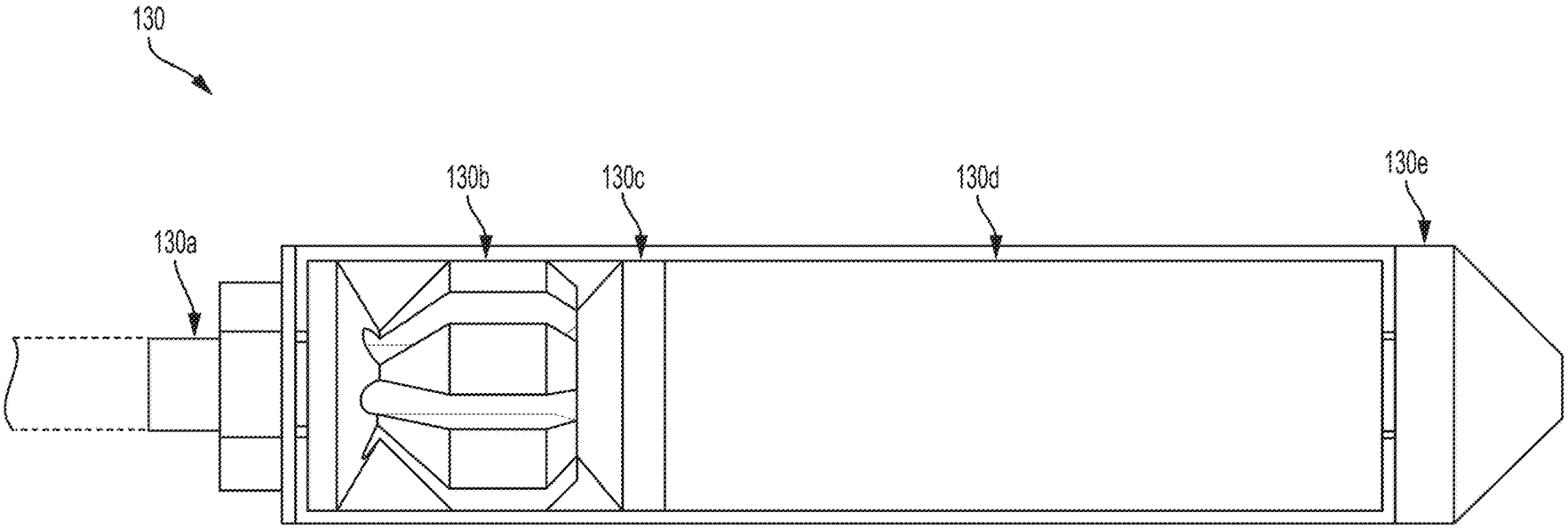
FIG. 5 is a cross-sectional view of an example of a high-expansion bridge plug in a run-in configuration according to some aspects of the present disclosure.

FIG. 5 depicts a cross-sectional view of a high-expansion bridge plug in a run-in configuration according to one example some. The HEBP 130 can include a core rod 130*a*, a slip 130*b*, an opening cone 130*c*, a compressible element 130*d*, and a insertion cone 130*e*. In the run-in configuration, the maximum outer diameter of any of the components of the HEBP 130 can be less than the inner diameter of a drill rod and the inner diameter of a drill bit.

The core rod 130*a* can provide structural support for the slip 130*b*, the opening cone 130*c*, the compressible element 130*d*, and the insertion cone 130*e*, such that these components are affixed to the core rod in a temporary or permanent manner or moveable with respect to the axis of the core rod 130*a*.

The slip 130*b*, the opening cone 130*c*, the compressible element 130*d*, and the insertion cone 130*e* can encircle the core rod 130*a* and extend radially outward from the core rod 130*a* to form a cylindrical shape capable of being passed through the inner diameter of a drill bit without damaging the HEBP 130. To ease the insertion of the HEBP 130 into and through the inner diameter of the drill bit, the insertion cone 130*e* can be tapered or any other shape conducive to allow the HEBP 130 to more accurately align when being inserted through the inner diameter of the drill bit.

Figure 6:
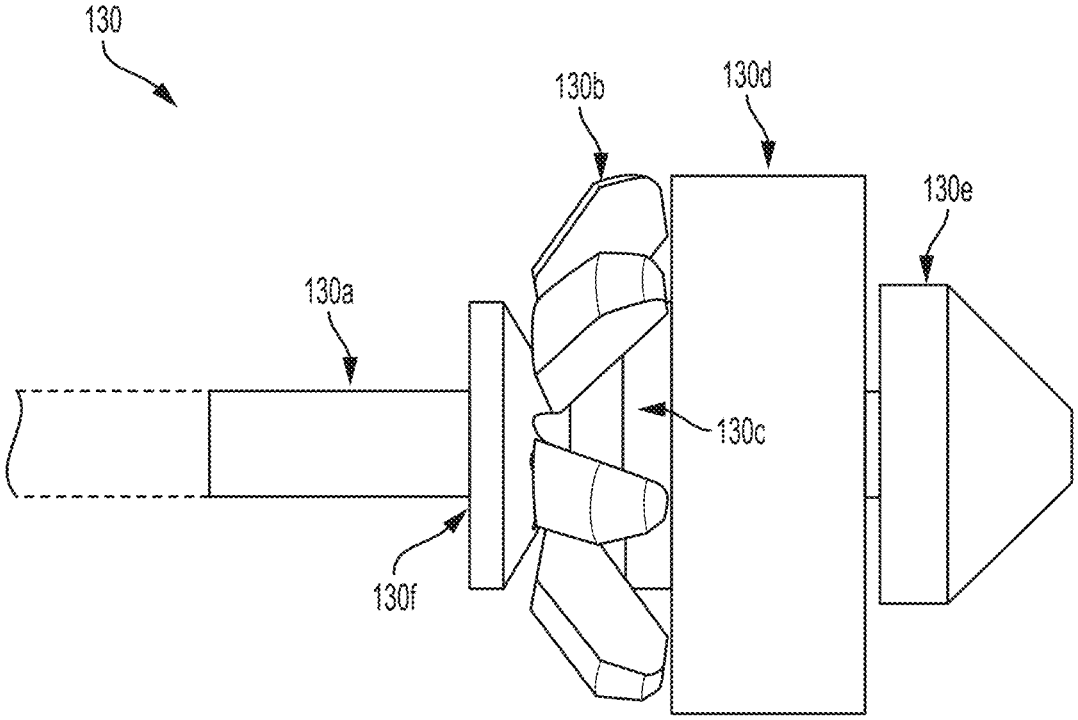
FIG. 6 is a cross-sectional view of an example of a high-expansion bridge plug in a set configuration according to some aspects of the present disclosure.

FIG. 6 depicts a cross-sectional view of a high-expansion bridge plug in a set configuration according to one example. A force can be applied by the DPU 120 through the setting kit 125 to the HEBP 130, such that the setting kit 125 can pull the core rod 130*a* uphole. Pulling the core rod 130*a* uphole can cause the compressible element 130*d* to expand radially outward towards the walls of the borehole. The opening cone 130*c* and the compressible element 130*d*, may not be permanently affixed to the core rod 130*a*, and may move along the length of the core rod 130*a*. The insertion cone 130*e*, which can be permanently affixed to the end of the core rod 130*a*, can move with the core rod 130*a* as the setting kit 125 pulls the core rod 130*a* uphole. The slip 130*b* can be a stationary component of the HEBP 13. The slip 130*b* can be permanently affixed to the core rod 130*a* and can act as a resistance point or anchor against which the insertion cone 130*e* compresses the compressible element 130*d*.

As the setting kit 125 pulls the insertion cone 130*e* uphole, the insertion cone 130*e* can begin to compress the compressible element 130*d*. The compressible element 130*d* can expand radially outward from the core rod 130*a* to plug the borehole. The compressible element 130*d*, which can be positioned adjacent to the opening cone 130*c*, can to exert force on the opening cone 130*c* in response to the force exerted on the compressible element 130*d* by the insertion cone 130*e*. The opening cone 130*c* can respond to the force exerted by the compressible element 130*d* by spreading prongs of the slip 130*b* radially outward. The prongs of the slip 130*b* can be shaped to allow the opening cone 130*c* to spread the prongs further outward as more force is exerted upon the opening cone 130*c* via the compressible element 130*d*. As the prongs of the slip 130*b* are forced outward, the slip 130*b* can exert force on a shearable location of the core rod 130*a* or on a shearable element 130*f*. The shearable element 130*f* can be part of the core rod 130*a* or may be a separate mechanism affixed to the core rod 130*a* that provides a shearable connection to the remaining components of the HEBP 130. When the prongs of the slip 130*b* have been forced far enough outward by the opening cone 130*c*, the slip 130*b* can shear off the components of the HEBP 130 from the upper portion of the core rod 130*a*.

Note that the force required to set the compressible element 130*d* in a set configuration (i.e. the compressible element 130*d* forms a seal against the walls of the borehole) can be achieved prior to achieving the force required to shear the shearable element 130*f* as applied by the slip 130*b*. This can ensure successful installation of the HEBP by preventing a shear event prior to sufficiently compressing the compressible element 130*d* to form a proper within the borehole.

In some examples, the opening cone 130*c* can act as an anchor against the compressible element 130*d* in place of the slip 130*b*. In this example, when enough force is exerted upon the opening cone 130*c* after the compressible element 130*d* is in a set configuration, the opening cone 130*c* can become dislodged instantaneously, causing the slip 130*b* to exert enough responsive force to shear the shearable element 130*f* instantaneously.

In some examples, the compressible element 130*d* can be made of material with a specific coefficient of elasticity to implement the embodiments such as Ethylene Propylene Diene Monomer (EPDM), rubber, and other elastomeric materials. The opening cone 130*c* can be made of a material that can provide sufficient rigidity to be able to bend the prongs of the slip 130*b* outward. The slip 130*b* can be made of a material that is ductile enough to be bent by the opening cone 130*c*, but rigid enough to apply sufficient force to the shearable element 130*f* to shear the HEBP 130 from the core rod 130*a* (e.g., stainless steel). As such, the material of the shearable element 130*f* can be more ductile than the material of the slip 130*b*

Figure 7:
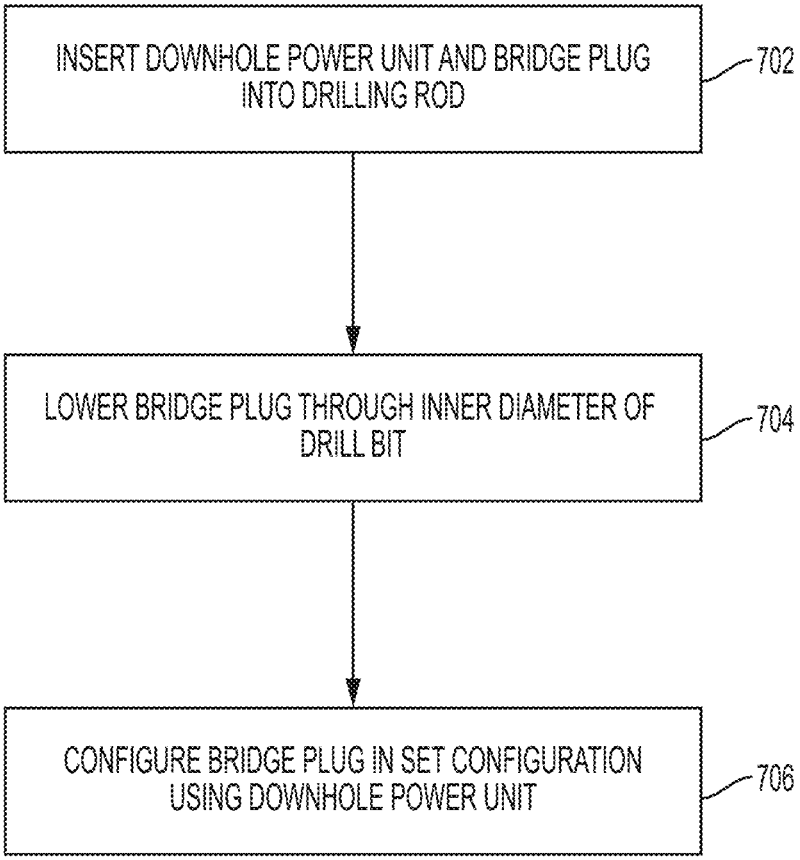
FIG. 7 is a flowchart of a process for setting bridge plugs in open hole while drill rods are in place according to some aspects of the present disclosure.

FIG. 7 depicts a flowchart of a process for setting bridge plugs in open hole while drill rods are in place according to one example. Some processes for setting a bridge plug using a DPU while drill rods are in place can be described according to previous examples. The processes described for setting bridge plugs in open hole while drill rods are in place can also be implemented in closed hole environments.

In block 702, a DPU and bridge plug is inserted into a drill rod in a drilling environment. The DPU can be sized to have a same or smaller diameter as a drilling rod. The bridge plug can have a run-in configuration of a diameter that is smaller than an inner diameter of a core bit (e.g., drill bit).

In block 704, the bridge plug is lowered into and through the inner diameter of the core bit using a winch. The bridge plug can be positioned beneath a drill bit of the drill rod, where the drill bit is attached to the drill rod.

In block 706, the bridge plug is configured by the DPU to be in a set configuration by pulling uphole. The diameter of the bridge plug in the set configuration can be greater than the diameter of the drilling rod. In some examples, the diameter of the bridge plug can be equal to the diameter of the open hole, sealing the bottom portion of the hole from the top portion of the hole. In the set configuration, the bridge plug can be expanded and maintain an increased diameter as compared to the diameter in the run-in configuration.

In some aspects, systems, devices, and methods for setting bridge plugs in open hole while drill rods are in place are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is an assembly comprising: a setting tool sized to have a diameter that is the same or smaller as the diameter of a drill rod; and a bridge plug having a run-in configuration in which the diameter of the bridge plug is smaller than an inner diameter of a core bit, and having a set configuration in response to the setting tool pulling in a direction toward a surface of a borehole, the bridge plug being positionable below a drill bit of the drill rod in the set configuration such that the drill bit is positioned between the bridge plug and the surface, the diameter of the bridge plug in the set configuration being greater than the diameter of the drill rod.

Example 2 is the assembly of example 1, wherein the bridge plug is a high-expansion bridge plug comprising: a slip; and a compressible element that is responsive to the setting tool pulling the compressible element toward the slip, the compressible element responding by expanding to maintain the compressible element in an increased diameter as compared to the diameter in the run-in configuration.

Example 3 is the assembly of example 2, the bridge plug further comprising: a shearable element located proximally to the slip, the slip being able to apply force to the shearable element in response to the bridge plug being in the set configuration, the shearable element being able to disconnect the setting tool from the bridge plug in response to the force.

Example 4 is the assembly of example 1, wherein the bridge plug is able to be inserted through the inner diameter of the core bit during the run-in configuration to be positionable beneath the drill bit prior to the set configuration.

Example 5 is the assembly of example 1, wherein the setting tool and bridge plug are located within the drill rod, the drill rod being rotatable around the setting tool and bridge plug during the run-in configuration and the set configuration.

Example 6 is the assembly of example 1, wherein the diameter of the bridge plug in the set configuration being greater than the diameter of the drill rod is equivalent to a diameter of an open hole in which the bridge plug is located.

Example 7 is the assembly of example 1, wherein the setting tool is configurable to record pressure versus time data during configuration of the bridge plug into the set configuration, the pressure versus time data being comparable to known pressure versus time data to determine a probability that the bridge plug was configured into the set configuration without error.

Example 8 is a bridge plug comprising: a slip; and a compressible element having a run-in configuration in which a diameter of the compressible element is smaller than an inner diameter of a core bit, and having a set configuration in response to a setting tool pulling in a direction toward the slip, the compressible element being positionable below a drill bit of a drill rod in the set configuration such that the drill bit is positioned between the bridge plug and a surface of a borehole, the diameter of the compressible element in the set configuration being greater than the diameter of the drill rod.

Example 9 is the bridge plug of example 8, wherein the compressible element in the set configuration expands to maintain the compressible element in an increased diameter as compared to the diameter in a run-in configuration.

Example 10 is the bridge plug of example 8, the bridge plug further comprising: a shearable element located proximally to the slip, the slip being able to apply force to the shearable element in response to the bridge plug being in the set configuration, the shearable element being able to disconnect the setting tool from the bridge plug in response to the force.

Example 11 is the bridge plug of example 8, wherein the bridge plug is able to be inserted through the inner diameter of the core bit during the run-in configuration to be positionable beneath the drill bit prior to the set configuration.

Example 12 is the bridge plug of example 8, wherein the bridge plug is located within the drill rod, the drill rod being rotatable around the bridge plug during the run-in configuration and the set configuration.

Example 13 is the bridge plug of example 8, wherein the diameter of the bridge plug in the set configuration being greater than the diameter of the drill rod is equivalent to a diameter of an open hole in which the bridge plug is located.

Example 14 is a method comprising: inserting a setting tool and bridge plug into a drill rod in a drilling environment, the setting tool sized to have a same or smaller diameter as a drill rod, the bridge plug having a run-in configuration of a diameter that is smaller than an inner diameter of a core bit; running, via a winch, the bridge plug into and through the inner diameter of the core bit, the bridge plug being positioned below a drill bit of the drill rod such that the drill bit is between the bridge plug and a surface of a borehole; and configuring, via the setting tool, the bridge plug into a set configuration in response to the setting tool pulling uphole, the diameter of the bridge plug in the set configuration being greater than the diameter of the drill rod.

Example 15 is the method of example 14, wherein configuring the set configuration of the bridge plug further comprises: pulling, via the setting tool, a compressible element of the bridge plug toward a slip, the slip being a stationary component of the bridge plug, the slip being positioned between the setting tool and the compressible element; expanding the compressible element in response to the pulling; and maintaining the compressible element in an increased diameter as compared to the diameter in the run-in configuration.

Example 16 is the method of example 15, wherein configuring the set configuration of the bridge plug further comprises: applying force, via the slip, to a shearable element in response to the pulling, the shearable element being located proximally to the slip; the shearable element connecting the setting tool to the bridge plug; and disconnecting the setting tool from the bridge plug in response to the force.

Example 17 is the method of example 14, further comprising: removing the setting tool from the drill rod in response to the bridge plug being in the set configuration; removing the drill rod from the drilling environment; and depositing a sealant within the drilling environment, the sealant being deposited on top of the bridge plug.

Example 18 is the method of example 14, wherein the setting tool and bridge plug are located within the drill rod, the drill rod being rotated around the setting tool and bridge plug during the run-in configuration and the set configuration.

Example 19 is the method of example 14, wherein the diameter of the bridge plug in the set configuration being greater than the diameter of the drill rod is equivalent to a diameter of an open hole in which the bridge plug is located.

Example 20 is the method of example 14, further comprising: recording, via the setting tool, pressure versus time data during the configuring of the bridge plug into the set configuration; removing the setting tool from the drill rod in response to the bridge plug being in the set configuration; receiving, via a computing device, the pressure versus time data from the setting tool; comparing, via the computing device, the pressure versus time data against known pressure versus time data; and determining, in response to the comparing, a probability that the bridge plug was configured into the set configuration without error.

Example 21 is a bridge plug comprising: a slip; and a compressible element having a run-in configuration in which a diameter of the compressible element is smaller than an inner diameter of a core bit, and having a set configuration in response to a setting tool pulling in a direction toward the slip, the compressible element being positionable below a drill bit of a drill rod in the set configuration such that the drill bit is positioned between the bridge plug and a surface of a borehole, the diameter of the compressible element in the set configuration being greater than the diameter of the drill rod.

Example 22 is the bridge plug of example 21, wherein the compressible element in the set configuration expands to maintain the compressible element in an increased diameter as compared to the diameter in a run-in configuration.

Example 23 is the bridge plug of any of example(s) 21 to 22, the bridge plug further comprising: a shearable element located proximally to the slip, the slip being able to apply force to the shearable element in response to the bridge plug being in the set configuration, the shearable element being able to disconnect the setting tool from the bridge plug in response to the force.

Example 24 is the bridge plug of any of example(s) 21 to 23, wherein the bridge plug is able to be inserted through the inner diameter of the core bit during the run-in configuration to be positionable beneath the drill bit prior to the set configuration.

Example 25 is the bridge plug of any of example(s) 21 to 24, wherein the bridge plug is located within the drill rod, the drill rod being rotatable around the bridge plug during the run-in configuration and the set configuration.

Example 26 is the bridge plug of any of example(s) 21 to 25, wherein the diameter of the bridge plug in the set configuration being greater than the diameter of the drill rod is equivalent to a diameter of an open hole in which the bridge plug is located.

Example 27 is the bridge plug of any of example(s) 21 to 26, wherein the bridge plug is in a system that comprises: the setting tool sized to have a diameter that is the same or smaller as the diameter of a drill rod.

Example 28 is the bridge plug of any of example(s) 21 to 27, wherein the setting tool is configurable to record pressure versus time data during configuration of the bridge plug into the set configuration, the pressure versus time data being comparable to known pressure versus time data to determine a probability that the bridge plug was configured into the set configuration without error.

Example 29 is a method comprising: inserting a setting tool and bridge plug into a drill rod in a drilling environment, the setting tool sized to have a same or smaller diameter as a drill rod, the bridge plug having a run-in configuration of a diameter that is smaller than an inner diameter of a core bit; running, via a winch, the bridge plug into and through the inner diameter of the core bit, the bridge plug being positioned below a drill bit of the drill rod such that the drill bit is between the bridge plug and a surface of a borehole; and configuring, via the setting tool, the bridge plug into a set configuration in response to the setting tool pulling uphole, the diameter of the bridge plug in the set configuration being greater than the diameter of the drill rod.

Example 30 is the method of example 29, wherein configuring the set configuration of the bridge plug further comprises: pulling, via the setting tool, a compressible element of the bridge plug toward a slip, the slip being a stationary component of the bridge plug, the slip being positioned between the setting tool and the compressible element; expanding the compressible element in response to the pulling; and maintaining the compressible element in an increased diameter as compared to the diameter in the run-in configuration.

Example 31 is the method of any of example(s) 29 to 30, wherein configuring the set configuration of the bridge plug further comprises: applying force, via the slip, to a shearable element in response to the pulling, the shearable element being located proximally to the slip; the shearable element connecting the setting tool to the bridge plug; and disconnecting the setting tool from the bridge plug in response to the force.

Example 32 is the method of any of example(s) 29 to 31, further comprising: removing the setting tool from the drill rod in response to the bridge plug being in the set configuration; removing the drill rod from the drilling environment; and depositing a sealant within the drilling environment, the sealant being deposited on top of the bridge plug.

Example 33 is the method of any of example(s) 29 to 32, wherein the setting tool and bridge plug are located within the drill rod, the drill rod being rotated around the setting tool and bridge plug during the run-in configuration and the set configuration.

Example 34 is the method of any of example(s) 29 to 33, wherein the diameter of the bridge plug in the set configuration being greater than the diameter of the drill rod is equivalent to a diameter of an open hole in which the bridge plug is located.

Example 35 is the method of any of example(s) 29 to 34, further comprising: recording, via the setting tool, pressure versus time data during the configuring of the bridge plug into the set configuration; removing the setting tool from the drill rod in response to the bridge plug being in the set configuration; receiving, via a computing device, the pressure versus time data from the setting tool; comparing, via the computing device, the pressure versus time data against known pressure versus time data; and determining, in response to the comparing, a probability that the bridge plug was configured into the set configuration without error.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. An assembly comprising:

a setting tool sized to have a diameter that is the same or smaller as the diameter of a drill rod, the setting tool configurable to record pressure versus time data during configuration of a bridge plug into a set configuration, the pressure versus time data comparable to known pressure versus time data to determine a probability that the bridge plug was configured into the set configuration without error; and the bridge plug having a run-in configuration in which the diameter of the bridge plug is smaller than an inner diameter of a core bit, and having the set configuration in response to the setting tool pulling in a direction toward a surface of a borehole, the bridge plug being positionable below a drill bit of the drill rod in the set configuration such that the drill bit is positioned between the bridge plug and the surface, the diameter of the bridge plug in the set configuration being greater than the diameter of the drill rod.

2. The assembly of claim 1, wherein the bridge plug is a high-expansion bridge plug comprising:

a slip; and a compressible element that is responsive to the setting tool pulling the compressible element toward the slip, the compressible element responding by expanding to maintain the compressible element in an increased diameter as compared to the diameter in the run-in configuration.

3. The assembly of claim 2, the bridge plug further comprising:

a shearable element located proximally to the slip, the slip being able to apply force to the shearable element in response to the bridge plug being in the set configuration, the shearable element being able to disconnect the setting tool from the bridge plug in response to the force.

4. The assembly of claim 1, wherein the bridge plug is able to be inserted through the inner diameter of the core bit during the run-in configuration to be positionable beneath the drill bit prior to the set configuration.

5. The assembly of claim 1, wherein the setting tool and bridge plug are located within the drill rod, the drill rod being rotatable around the setting tool and bridge plug during the run-in configuration and the set configuration.

6. The assembly of claim 1, wherein the diameter of the bridge plug in the set configuration being greater than the diameter of the drill rod is equivalent to a diameter of an open hole in which the bridge plug is located.

7. A setting tool comprising:

An outer diameter sized to be the same or smaller as a diameter of a drill rod, the setting tool configurable to record pressure versus time data during configuration of a bridge plug into a set configuration, the pressure versus time data comparable to known pressure versus time data to determine a probability that the bridge plug was configured into the set configuration without error, wherein the bridge plug has a run-in configuration in which the diameter of the bridge plug is smaller than an inner diameter of a core bit, and has the set configuration in response to the setting tool pulling in a direction toward a surface of a borehole, the bridge plug being positionable below a drill bit of the drill rod in the set configuration such that the drill bit is positioned between the bridge plug and the surface, the diameter of the bridge plug in the set configuration being greater than the diameter of the drill rod.

8. The setting tool of claim 7, wherein a compressible element of the bridge plug in the set configuration expands to maintain the compressible element in an increased diameter as compared to the diameter in a run-in configuration of the bridge plug.

9. The setting tool of claim 7, wherein the bridge plug includes:

a slip; and a shearable element located proximally to the slip, the slip being able to apply force to the shearable element in response to the bridge plug being in the set configuration, the shearable element being able to disconnect the setting tool from the bridge plug in response to the force.

10. The setting tool of claim 7, wherein the bridge plug is able to be inserted through the inner diameter of the core bit during the run-in configuration to be positionable beneath the drill bit prior to the set configuration.

11. The setting tool of claim 7, wherein the bridge plug is located within the drill rod, the drill rod being rotatable around the bridge plug during the run-in configuration and the set configuration.

12. The setting tool of claim 7, wherein the diameter of the bridge plug in the set configuration being greater than the diameter of the drill rod is equivalent to a diameter of an open hole in which the bridge plug is located.

13. A method comprising:

inserting a setting tool and bridge plug into a drill rod in a drilling environment, the setting tool sized to have a same or smaller diameter as a drill rod, the bridge plug having a run-in configuration of a diameter that is smaller than an inner diameter of a core bit;

running, via a winch, the bridge plug into and through the inner diameter of the core bit, the bridge plug being positioned below a drill bit of the drill rod such that the drill bit is between the bridge plug and a surface of a borehole;

configuring, via the setting tool, the bridge plug into a set configuration in response to the setting tool pulling uphole, the diameter of the bridge plug in the set configuration being greater than the diameter of the drill rod; and determining, via a computing device and by comparing pressure versus time data against known pressure versus time data, a probability that the bridge plug was configured into the set configuration without error.

14. The method of claim 13, wherein configuring the set configuration of the bridge plug further comprises:

pulling, via the setting tool, a compressible element of the bridge plug toward a slip, the slip being a stationary component of the bridge plug, the slip being positioned between the setting tool and the compressible element;

expanding the compressible element in response to the pulling; and maintaining the compressible element in an increased diameter as compared to the diameter in the run-in configuration.

15. The method of claim 14, wherein configuring the set configuration of the bridge plug further comprises:

applying force, via the slip, to a shearable element in response to the pulling, the shearable element being located proximally to the slip; the shearable element connecting the setting tool to the bridge plug; and disconnecting the setting tool from the bridge plug in response to the force.

16. The method of claim 13, further comprising:

removing the setting tool from the drill rod in response to the bridge plug being in the set configuration;

removing the drill rod from the drilling environment; and depositing a sealant within the drilling environment, the sealant being deposited on top of the bridge plug.

17. The method of claim 13, wherein the setting tool and bridge plug are located within the drill rod, the drill rod being rotated around the setting tool and bridge plug during the run-in configuration and the set configuration.

18. The method of claim 13, wherein the diameter of the bridge plug in the set configuration being greater than the diameter of the drill rod is equivalent to a diameter of an open hole in which the bridge plug is located.

19. The method of claim 13, wherein determining, via the computing device and by comparing the pressure versus time data against known pressure versus time data, the probability that the bridge plug was configured into the set configuration without error includes:

recording, via the setting tool, the pressure versus time data during the configuring of the bridge plug into the set configuration;

removing the setting tool from the drill rod in response to the bridge plug being in the set configuration; and receiving, via the computing device, the pressure versus time data from the setting tool.

* * * * *